United States Patent [19]

Samuel

[11] 4,425,878

[45] Jan. 17, 1984

[54] INTERNAL COMBUSTION ENGINE COOLING METHOD AND DEVICE

[75] Inventor: Olof Samuel, Saltsjö-Boo, Sweden

[73] Assignee: Nordstjernan AB, Stockholm, Sweden

[21] Appl. No.: 359,662

[22] PCT Filed: Jul. 10, 1981

[86] PCT No.: PCT/SE81/00215

§ 371 Date: Feb. 25, 1982

§ 102(e) Date: Feb. 25, 1982

[87] PCT Pub. No.: WO82/00317

PCT Pub. Date: Feb. 4, 1982

[30] Foreign Application Priority Data

Jul. 10, 1980 [SE] Sweden ..... 8005086

[51] Int. Cl.[3] ..... F01P 5/10; F01P 7/14

[52] U.S. Cl. ..... 123/41.08; 123/41.44

[58] Field of Search ..... 123/41.08, 41.09, 41.1, 123/41.01, 41.02, 41.44, 41.49, 41.48

[56] References Cited

U.S. PATENT DOCUMENTS 3,805,748 4/1974 Garcea et al. ..... 123/41.1
4,249,491 2/1981 Stein ..... 123/196 AB
4,286,551 9/1981 Blite ..... 123/41.31

FOREIGN PATENT DOCUMENTS 2388994 11/1978 France ..... 123/41.02

*Primary Examiner*—William A. Cuchlinski, Jr.
*Attorney, Agent, or Firm*—Holman & Stern

[57] ABSTRACT

This invention relates to a method and a device for controlling the cooling of internal combustion engines in order to reduce the corrosive wear of cylinder barrels and piston rings. The corrosion substantially is caused by the sulphur content of the fuel. In a Diesel engine the combustion of the fuel always takes place at a relatively great air excess, which implies that the formation of sulphur trioxide exceeds the formation of sulphur dioxide. Together with the water vapor in the flue gases, in addition to sulphurous acid the stronger sulphuric acid is formed. The corrosion in combination with the wear result in a much too short life of the cylinder liners and piston rings and constitute a significant economic problem. Known tests show for the corrosion of steel in flue gas with 0,01 and 0,02% $SO_3$-content a very distinctive maximum at about 150° C., but corrosion minima on both sides of said maximum. The corrosion can be reduced by maintaining the surface temperature for cylinder barrels and piston rings below the lower temperature limit for maximum corrosion due to $SO_3$-content in the flue gas by tempering the coolant while the engine is subjected to a load up to a certain partial load, and at increasing output and upon arrival at said partial load causing an abrupt increase in the surface temperature to a value above the upper temperature limit for said maximum corrosion, and maintaining the surface temperature thereafter above this value by tempering of the coolant.

11 Claims, 4 Drawing Figures

INTERNAL COMBUSTION ENGINE COOLING METHOD AND DEVICE

BACKGROUND OF THE INVENTION

1. Field of the Invention

This invention relates to a method and device for controlling the cooling of internal combustion engines in order to reduce corrosive wear of cylinder barrels and piston rings.

2. Description of the Prior Art

The wear of cylinder liners and piston rings in a Diesel engine in most cases is corrosive wear. This applies particularly to engines with high mean pressure. The corrosion substantially is caused by the sulphur content in the fuel. In a Diesel engine in fuel always is combusted at relatively high air excess, which implies that the formation of sulphur trioxide exceeds the formation of sulphur dioxide. Together with the water vapour in the flue gases, the stronger sulphuric acid is formed in addition to sulphurous acid. Due to the combination of corrosion and mechanical wear, the life of the cylinder liners and piston rings is much too short and, thus, constitutes a significant economic problem.

When instead of heavy oil, Diesel oil was used, which has a lower sulphur content, the wear generally was reduced. For various reasons, however, the sulphur content in Diesel oil has been increased lately and thereby the advantages of Diesel oil over heavy oil have decreased. It was found by known experiments, that the corrosion of steel in flue gas with a $SO_3$-content of 0.01 and 0.02% has a very distinctive maximum at about 150° C., but that on both sides of the maximum minima are found. Temperatures immediately above 170° C. to 180° C., for example, and immediately below 110° C. to 120° C. are favourable from a corrosion point of view. These temperatures vary slightly with the analysis of the steel and the $SO_3$-content of the flue gas, but generally it can be said, that the temperature range between 120° C. and 170° C. of a cylinder liner or piston ring is definitely unfavourable from the corrosion aspect. The temperature of the cylinder liner or, more correctly, the surface temperature on the inside of the cylinder liner, in modern Diesel engines usually is 170°–180° C. when the engine operates at full power output. The temperature, thus, is within a range, at which the corrosion is relatively low and close to minimum. Corrosion problems arise when the engine operates at partial load of its maximum output. Owing to the cooling of cylinder liners and piston rings, their temperature decreases into the corrosive temperature range. Diesel engines or internal combustion engines generally are cooled by a coolant circulated through various passageways and spaces in the engine. The coolant passes outside the engine through a radiator, which is cooled in suitable manner. The cooling unit possibly may be a water intake from a larger water source, for example, sea water or the like. A shunt duct provided for controlling the coolant passageways of the engine is returned by suitably adjusting a three-way valve. The ingoing coolant to the engine, thus, is a mixture of coolant coming from the radiator and return coolant from the engine shunted through the three-way valve.

BRIEF SUMMARY OF THE INVENTION

The present invention has the object to prevent the surface temperature of cylinder barrels and piston rings during different operation conditions from staying within the aforementioned corrosive temperature range. The cooling, thus, is to be effected so that the surface temperature for cylinder barrels and piston rings either is above the temperature range where corrosion most rapidly occurs, or below said range. It has proved impossible in practice to maintain the temperature in either of the temperature ranges above or below the said corrosive range. The invention is characterized in that the surface temperature for cylinder barrels and piston rings is maintained substantially constant and below the lower temperature limit of risked corrosion maxima due to the $SO_3$-content in the flue gas by tempering the coolant during an engine output up to a certain partial output, that at increasing output and upon arrival at said partial output the coolant temperature causes an abrupt increase of the surface temperature to a value above the upper temperature limit for said risked corrosion maxima, and that the surface temperature thereafter is maintained above said value by tempering the coolant.

DESCRIPTION OF THE DRAWINGS

The invention will now be described in detail, with reference to the accompanying drawings wherein.

DETAILED DESCRIPTION

Figure 1:
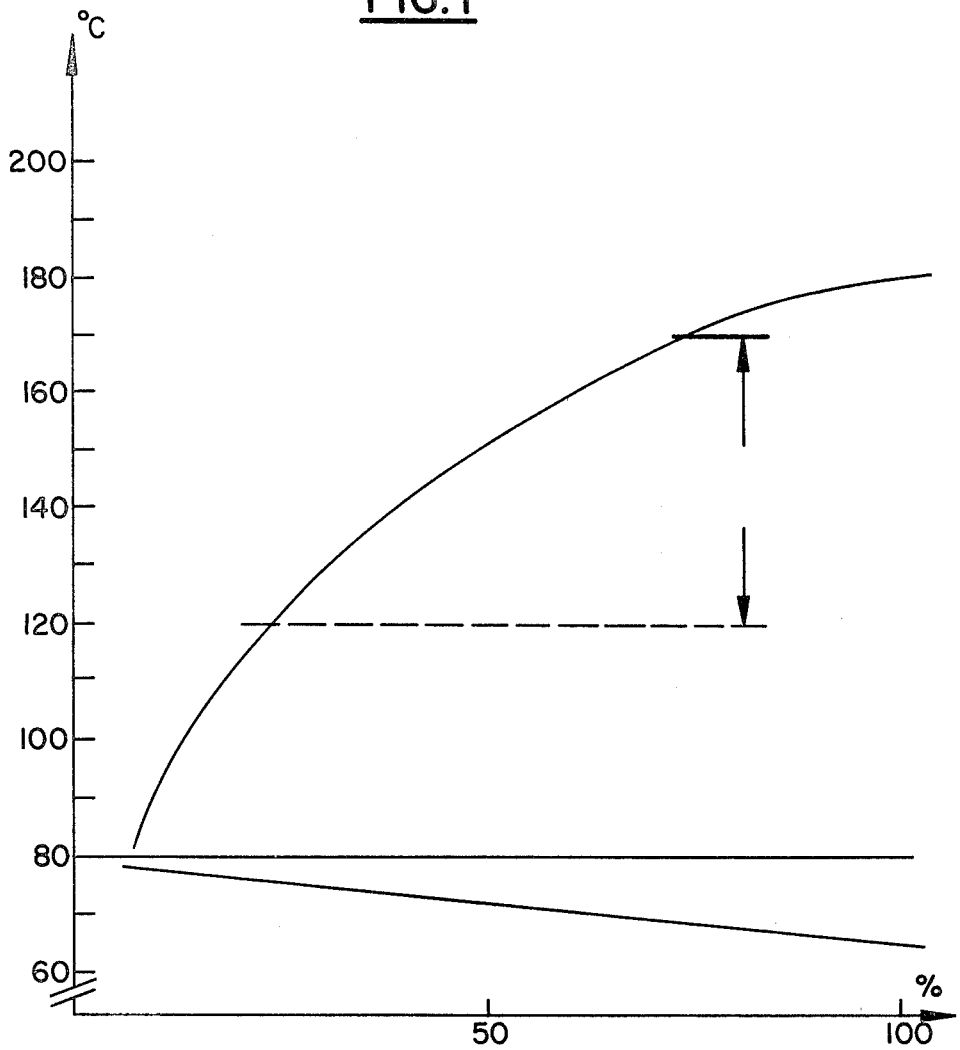
FIG. 1 is a graph showing the relation between the surface temperature for cylinder barrels and piston rings as a function of the output of a Diesel engine and the temperature for outgoing and ingoing cooling water as a function of the output.

The known technique of controlling the cooling water of a Diesel engine results in a cooling process as illustrated in FIG. 1. In this example of the cooling process the outgoing cooling water is maintained at a constant temperature. The ingoing cooling water, therefore, by its shunting assumes a temperature, which is increasingly higher the lower the output. At full output the temperature of the cylinder barrels is about 180° C. because the cooling is adjusted thereto. Already at partial output of about 70%, however, the cylinder barrel temperature according to this example will decrease to the afore-mentioned corrosive temperature range and remain there until the output is below about 20%. It appears from the Figure as known that in conventional cooling systems for internal combustion engines and especially Diesel engines the temperature in cylinder barrels and piston rings varies with the output.

Figure 2:
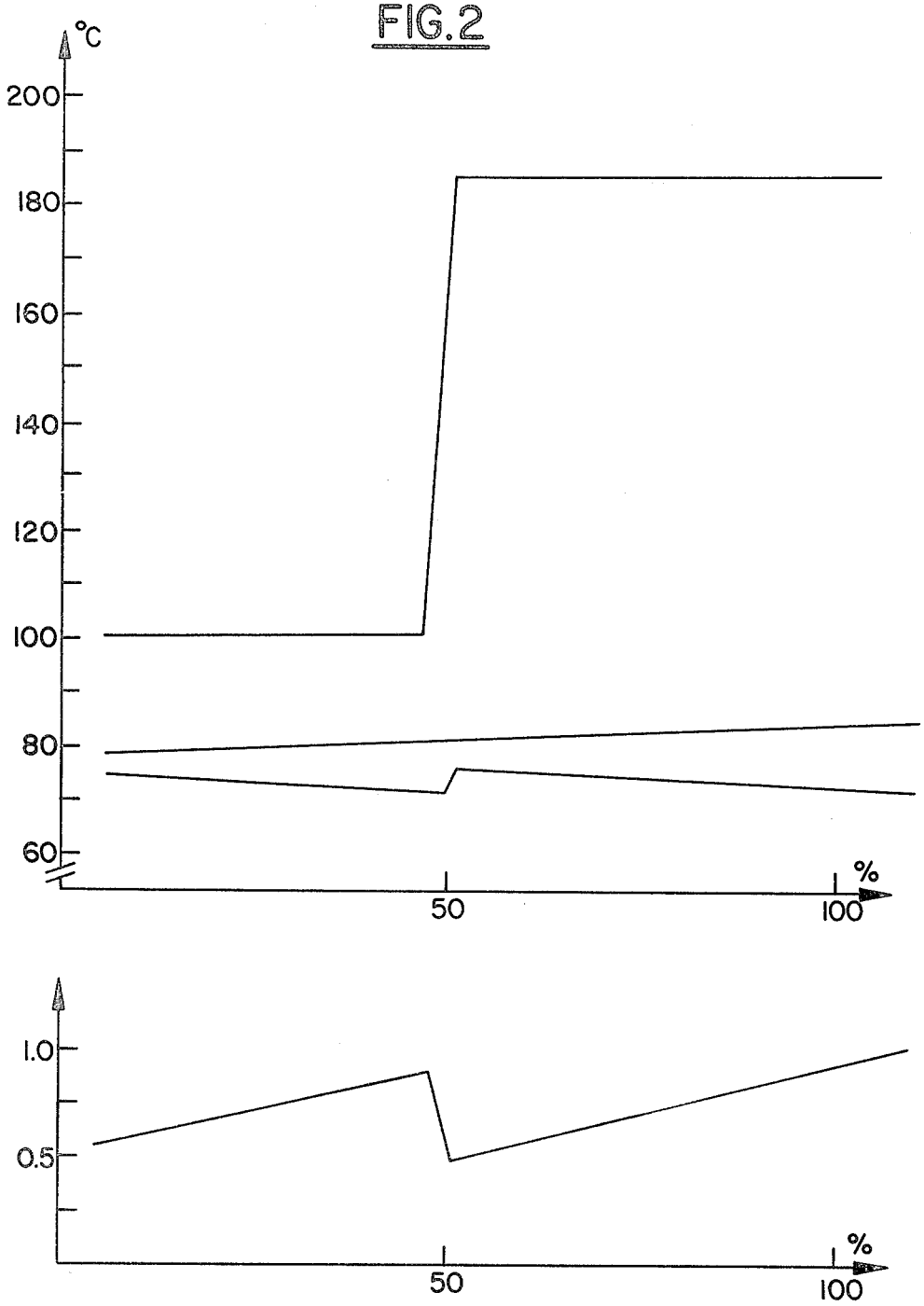
FIG. 2 shows for better clarity two graphs, one above the other, from which the invention and the progress of the surface temperature for cylinder barrels and piston rings as a function of the output are apparent, and where also the temperature of the outgoing and ingoing cooling water and the rate of the circulating coolant as a function of the output are shown.

The idea of the invention is apparent from FIG. 2, in which is shown that the cooling effect is controlled in such a way, that the temperature for cylinder barrels at lower engine output is maintained constant at about 100° C., but when an engine output of, for example, 50% is attained, the surface temperature for cylinder barrels and piston rings is allowed to abruptly and rapidly rise to about 180° C., i.e. above said corrosive temperature range. The aforesaid relation, of course, also applies when the output is decreased from full output for the Diesel engine down to shutting-off the engine. It is apparent, thus, that in principle two temperatures for cylinder barrels and piston rings are maintained, and that this takes place in response to the engine output.

The cooling process must be controlled very strictly by a control unit. Said unit receives for this purpose input signals from the output and from the ingoing and outgoing cooling water temperature. By means of these three parameters, the control unit adjusts the cooling process so that the result shown in FIG. 2 is obtained. This result, however, cannot be achieved in a conventional way, i.e. by shunting the cooling circuit. According to the invention, the cooling is controlled by changing the cooling water rate through the engine in relation to the engine output. By changing the cooling water rate or coolant rate, as a matter of fact, the heat transfer coefficient for metal to water is affected, as $$\alpha = f(Re) = f(d \cdot v/\eta),$$

where

Re is Reynold's number d is the water passageway diameter v is the water rate, and $\eta$ is the water viscosity.

The coolant mentioned heretofore and to be mentioned henceforth is water but, of course, also other liquids can be imagined. The water rate can be adjusted by different means as will be described in the following.

In FIG. 2 the afore-mentioned cooling process is illustrated in a schematic manner. In the upper part of FIG. 2 the temperature progress of the cooling water outgoing from and ingoing into the engine is shown as a function of the engine output. The control of the water rate has a clearly dominating influence on the cooling effect. The control by shunting the ingoing cooling water, therefore, rather is of a correcting nature. The temperature progress for the cooling water ingoing into and outgoing from the engine, as illustrated in FIG. 2, therefore, is shown only by way of example and can vary considerably, depending on the water rate chosen and on different engine types. When, as shown here, the outgoing cooling water temperature is chosen to follow a continuous temperature progress, the ingoing cooling water temperature, for example, may have to be controlled according to the progress shown here, i.e. a progress decreasing with increased output, but with abrupt increase simultaneously with a reduction of the water rate. The lower curve in FIG. 2 illustrates the water rate which, as can be seen, increases continuously from about 0.60 of full rate up to about 0.90 of full rate with increasing output up to an output close to 45%. Thereafter, the water rate drops drastically for a very short period of increasing output, so that the water rate drops to below half the full water rate. As a result thereof, the cooling effect is reduced substantially, resulting in a rapidly increasing temperature for cylinder barrels and piston rings. By the upper part of FIG. 2 and the uppermost curve is illustrated how by the almost vertical line the surface temperature for the said members rises from 100° C. to 180° C. The curve in question is designated as liner. From this load point, i.e. at a load of about 45%, the cooling demand increases with increasing output. Therefore, as appears from the lower curve in FIG. 2, the water rate must increase from this point of partial load up to full output. The water rate, thus, is the parameter to be subjected to the greatest variations in order to influence the cooling process for the engine. It can be assumed that the water rate for cooling at full output in FIG. 2 is indicated by the value 1.0 and the water rate can be adjusted downward from this value. It is, thus, also apparent from FIG. 2 that the surface temperature for cylinder barrels and piston rings is within the afore-mentioned high corrosion temperature range only for a very short partial output change. Of course, that partial output, at which the abrupt temperature change occurs, must not be for a long period of time, but must be quickly passed through. It is apparent, thus, that as a suitable point for the abrupt change in temperature a partial output point is selected which suits the engine mode of operation in general, i.e. a partial output used only at the engine passing from start to a drive output and back.

Figure 3:
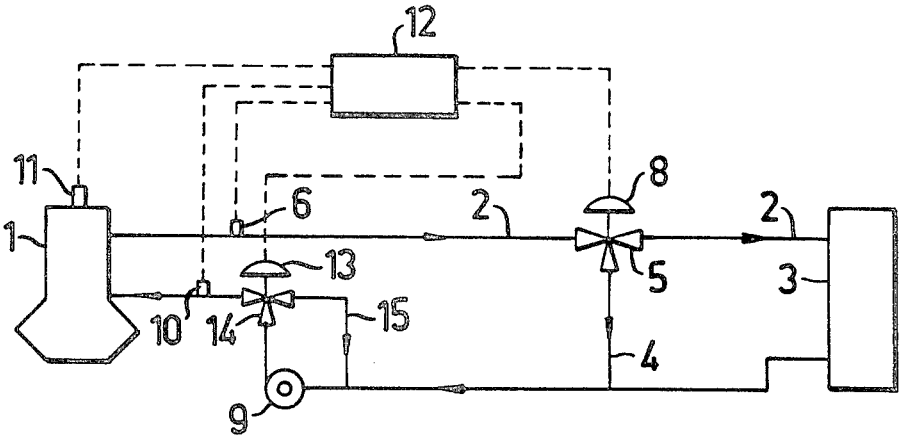
FIG. 3 is a schematic flow chart of the coolant system for a Diesel engine and of the control technique according to the invention.

In FIG. 3 a cooling water system for a Diesel engine is shown. The engine 1 comprises an outgoing cooling water duct 2 extending to a radiator 3. From the radiator 3 the cooling water is passed to the cooling water inlet of the engine. The numeral 4 designates a shunt duct, which by-pass connects the outgoing cooling water duct 2 relative to the radiator 3 by means of a three-way valve 5. This represents also the known art. A control device 8 adjusts the three-way valve 5 so that the ingoing cooling water temperature to the engine is maintained at desired values. According to known art, the control device 8 previously has received signals for adjusting the three-way valve in response to the outgoing cooling water temperature.

A circulation pump 9 causes the cooling water to circulate through the engine 1. In the embodiment shown in FIG. 3, the circulation pump is assumed to operate at constant output. In order to control, according to the invention idea, the cooling water rate, and therewith the cooling effect of the cooling water, a three-way valve 14 is provided downstream of the circulation pump 9, which valve feeds cooling water to the engine and returns cooling water in the coil 15 to the inlet side of the circulation pump. The three-way valve 14 is adjusted by a control device 13.

A control unit 12 is provided for adjusting the two three-way valves 5 and 14. The output signals of this control unit, as shown in FIG. 3, are passed to the control device 8 and control device 13, respectively. The most important input signal to the control unit 12 arrives from a transducer 11 on the engine which, by input signals to the control device indicates the load to which the engine is exposed, i.e. the output at which the engine operates. At a certain output, say 50%, as explained above with reference to FIG. 2, the water rate is to be reduced rapidly. Furthermore, the ingoing cooling water temperature is to be lowered. A signal from the transducer 11 informs the control unit 12 when the output is the one mentioned. A transducer 6 is located at the outgoing cooling water duct from the engine, and a transducer 10 is located on the ingoing duct at the engine. Signals from the transducers are sent to the control unit 12, which composes the three input signals from the transducers so that the progress according to FIG. 2 is established. At an output of say 50%, both the control device 8 and the control device 13 receive signals from the control unit 12, and the two three-way valves 5 and 14, respectively, are so adjusted that the cooling effect decreases rapidly. This gives rise to the rapidly increased temperature for cylinder barrels and piston rings. The control device 8, thus, adjusts the three-way valve 5 so that the ingoing cooling water temperature rapidly is lowered or allowed to lower, but the essential feature is that the three-way valve 14 is adjusted so, that the water rate rapidly is reduced at said output. This is effected so that by means of the three-way valve 14 and shunt duct 15 circulation occurs through the pump 9 whereby the water rate through the engine 1 is reduced.

The control unit 12 is constructed according to known art. It comprises three pre-amplifiers, one for each ingoing signal from the transducers 6, 10 and 11. The amplified signals then pass to a function generator, which includes a mathematic pattern of a suitable control progress, for example the one shown in FIG. 2. The function generator converts according to said pattern the input signals to control signals for the valve positions of the two three-way valves 5 and 14. The control signals pass through a final amplifier, one for each valve, for generating control current to the control devices 8 and 13 of the valves. When the valves are controlled pneumatically, the amplified control signals pass to a pressure converter.

Figure 4:
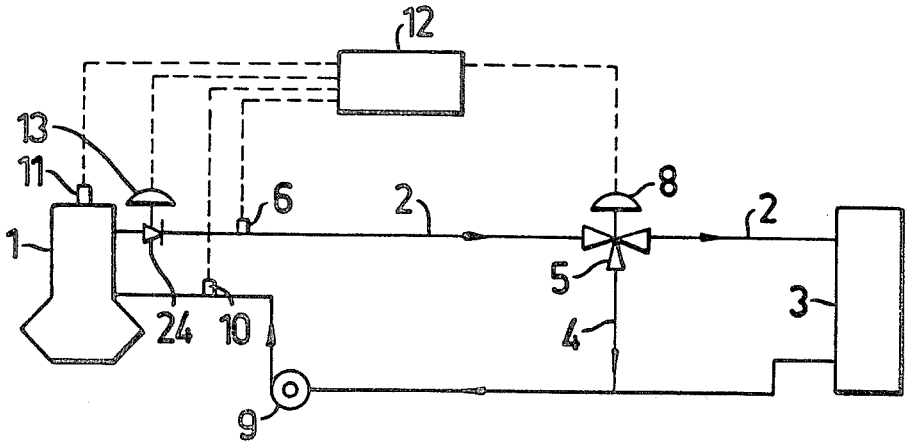
FIG. 4 is a schematic flow chart similar to FIG. 3 and shows the invention in another embodiment.

The output of the engine can be measured by an output meter of known kind attached to the engine output shaft. The output meter is provided with the transducer 11 which, thus, emits a signal as a measure of the output. A fully applicable approximate value of the output of the engine can also be obtained by sensing the regulator position of the fuel pumps. Temperature transducers as well as pneumatic and electric control devices for the valves are commercially available. An imaginable but in practice inferior variant of the cooling water system according to the invention is illustrated in FIG. 4 where the course of events is the same as in FIG. 3. The only difference in relation to the embodiment shown in FIG. 3 is that the three-way valve 14 has been replaced by an adjustable throtting member 24. By increasing or decreasing the throttling effect by means of the member 24 the water rate through the cooling water ducts of the engine is increased or reduced. In a further embodiment (not shown) the circulation pump is driven so that its capacity can be varied. This can be effected by a variable speed motor with. When the circulation pump, for example, is a centrifugal pump, the rotation speed for the drive motor is reduced and increased, respectively, whereby the pump effect is changed according to the desired flow rate for the cooling water.

The invention has been described above by way of some imagineable embodiments. It is especially to be observed, thus, that in the foregoing the water rate, and therewith the surface temperature for cylinder barrels and piston rings, rapidly shall be changed at an optional partial output, say about 50% of full output. According to the introductory portion above, the temperature range where the corrosion risk is greatest varies slightly with the analysis of the material, i.e. the analysis of the material in the cylinder barrels and piston rings, and also with the $SO_3$-content of the flue gases. The temperature limits 100° C. and 180° C. for the surface temperature of the liner (cylinder barrel) stated in FIG. 2, thus, are stated by way of example. The limits, thus, may be varied according to the knowledge of the analysis of the material and the $SO_3$-content of the flue gases.

I claim:

1. A method for cooling internal combustion engines for reducing corrosive wear of cylinder barrels and piston rings, comprising maintaining the surface temperature for cylinder barrels and piston rings below the lower temperature limit for maximum corrosion due to the $SO_3$-content in the flue gas by controlling the cooling effect while the engine is subjected to a load up a predetermined partial load, at increasing engine output and when said partial load has been arrived at adjusting the cooling effect so that the surface temperature is increased abruptly to a value above the upper limit of temperature for said maximum corrosion, and maintaining the surface temperature thereafter above said value.

2. A method as defined in claim 1, wherein said adjusting of the coolant temperature comprises at least controlling the coolant flow rate through the engine.

3. A method as defined in claim 2, comprising increasing the coolant flow rate with increasing engine output, and at said predetermined partial output reducing the flow rate abruptly.

4. A method as defined in claim 2 or 3, comprising abruptly changing the engine inlet coolant temperature at the predetermined partial output by shunting with coolant from the engine outlet.

5. A method as defined in claim 4, wherein the inlet coolant temperature in general is continuously adjusted with outgoing coolant.

6. A device for controlling the cooling of internal combustion engines having a closed circuit cooling system including a radiator and a pump in order to reduce corrosive wear of cylinder barrels and piston rings by controlling their surface temperature comprising a control unit, a transducer operably mounted on the engine to produce signals corresponding to the engine output and operably connected to said control unit to transmit said signals as input signals to said control unit, said control unit in response to said output signals of said transducer emitting output signals, coolant flow rate control means operably connected in the coolant circuit of the engine and to said control unit to receive said output signals and in response thereto control the coolant flow rate through the engine.

7. A device as defined in claim 6, wherein said flow rate control means comprises a constant-controlled circulation pump, a three-way valve operably connected in the coolant circuit between the pump and engine inlet and having a first outlet duct connected to the engine inlet and a second outlet duct connected to the suction side of the pump.

8. A device as defined in claim 6, wherein said flow rate control means comprises an adjustable speed circulation pump operably inserted in said coolant circuit.

9. A device as defined in claim 6, wherein said flow rate control means comprises an adjustable throttling member operably connected in said coolant circuit for the engine.

10. A device as claimed in claim 6 and further comprising a three-way valve operably connected in the coolant circuit to by-pass coolant from the radiator inlet directly to the radiator outlet, and means for controlling the position of said three-way valve operably connected to said control unit so that it is controlled thereby.

11. A device as claimed in any one of claims 6 or 10 and further comprising a transducer operably connected to the engine coolant outlet and a transducer operably connected to the engine coolant inlet, said transducers being operably connected to said control unit to indicate the temperature of the coolant at their respective locations.

* * * * *